US008890909B2

(12) United States Patent
Fukutoku

(10) Patent No.: US 8,890,909 B2
(45) Date of Patent: Nov. 18, 2014

(54) POWER CONTROL DEVICE, BACKLIGHT UNIT, AND LIQUID CRYSTAL DISPLAY DEVICE

(75) Inventor: Shouichi Fukutoku, Osaka (JP)

(73) Assignee: Sharp Kabushiki Kaisha, Osaka (JP)

( * ) Notice: Subject to any disclaimer, the term of this patent is extended or adjusted under 35 U.S.C. 154(b) by 204 days.

(21) Appl. No.: 13/581,877

(22) PCT Filed: Dec. 1, 2010

(86) PCT No.: PCT/JP2010/071444

§ 371 (c)(1),
(2), (4) Date: Aug. 30, 2012

(87) PCT Pub. No.: WO2011/121846

PCT Pub. Date: Oct. 6, 2011

(65) Prior Publication Data

US 2012/0326628 A1 Dec. 27, 2012

(30) Foreign Application Priority Data

Mar. 29, 2010 (JP) ..... 2010-074045

(51) Int. Cl.

| | |
|---|---|
| ***G09G 5/00*** | (2006.01) |
| ***G09G 3/34*** | (2006.01) |
| ***H05B 33/08*** | (2006.01) |
| *G09G 3/36* | (2006.01) |

(52) U.S. Cl.

CPC ..... *G09G 3/342* (2013.01); *H05B 33/0815* (2013.01); *G09G 3/3611* (2013.01); *G09G 2320/064* (2013.01); *G09G 2330/00* (2013.01); *G09G 2330/06* (2013.01)

USPC ..... 345/691; 345/690; 345/38; 345/39; 315/360; 315/294

(58) Field of Classification Search

CPC ..... G09G 2320/0276; G09G 3/2014; H05B 37/029

USPC ..... 315/294, 360; 345/690, 691, 38, 39

See application file for complete search history.

(56) References Cited

U.S. PATENT DOCUMENTS

| | | | | |
|---|---|---|---|---|
| 2006/0125774 | A1 | 6/2006 | Nishigaki | |
| 2007/0268318 | A1 * | 11/2007 | Mu et al. | 345/691 |
| 2008/0179498 | A1 | 7/2008 | Shimizu | |
| 2010/0097412 | A1 | 4/2010 | Okabe | |
| 2011/0084987 | A1 * | 4/2011 | Kim et al. | 345/690 |

FOREIGN PATENT DOCUMENTS

| | | | | |
|---|---|---|---|---|
| EP | 1 126 618 | A2 | 8/2001 | |
| JP | 2001-230660 | A | 8/2001 | |
| JP | 2001230660 | * | 8/2001 | G06F 1/06 |
| JP | 2004-233569 | A | 8/2004 | |
| JP | 2006-164842 | A | 6/2006 | |
| JP | 2007-287964 | A | 11/2007 | |
| JP | 2008-192324 | A | 8/2008 | |
| JP | 2008-210878 | A | 9/2008 | |

OTHER PUBLICATIONS

Official Communication issued in International Patent Application No. PCT/JP2010/071444, mailed on Dec. 28, 2010.

* cited by examiner

*Primary Examiner* — Douglas W Owens
*Assistant Examiner* — Syed M Kaiser
(74) *Attorney, Agent, or Firm* — Keating & Bennett, LLP

(57) ABSTRACT

Disclosed is a power control device, which generates PWM signals corresponding to obtained voltage signals, and which performs PWM control of power to be supplied to a load. The power control device is provided with a sampling section that performs sampling of the voltage signals, and a duty factor updating section, which updates the duty factor of the PWM signals on the basis of the sampling results. The sampling section is prevented from performing sampling during a masking period which is set as the on-period or the off-period of the PWM signals.

9 Claims, 7 Drawing Sheets

POWER CONTROL DEVICE, BACKLIGHT UNIT, AND LIQUID CRYSTAL DISPLAY DEVICE

TECHNICAL FIELD

The present invention relates to power control devices that control electric power supplied to a load, and also relates to backlight units and liquid crystal display devices that employ such power control devices.

BACKGROUND ART

Conventionally, power control devices that perform PWM (pulse width modulation) control of electric power supplied to an electric load such as a light emitting element have widely been used. The configuration etc. of such power control devices will be described briefly below, taking as an example an LED control device that controls electric power supplied to an LED (light-emitting diode).

FIG. 6 is a configuration diagram of the LED control device. As shown there, the LED control device 100 includes a PWM signal generation circuit 102, an LED drive circuit 103, a power supply circuit 104, etc.

The PWM signal generation circuit 102 receives a lighting control voltage from outside. The lighting control voltage is a voltage that represents the desired emission luminance (the voltage value correlates with the emission luminance), and is, for example, generated in an external device according to an instruction from the user. That is, the lighting control voltage is an analog voltage signal that represents the desired emission luminance.

The PWM signal generation circuit 102 generates, based on the received lighting control voltage, a PWM signal (pulse signal) that is going to be used in the PWM control of the electric power supplied to an LED (the electric current passed through the LED). In the PWM signal, H level represents an on state and L level represents an off state.

The LED drive circuit 103 continuously receives the PWM signal, and drives the LED 200 as a drive target according to the PWM signal. That is, by using the electric power supplied from the power supply circuit 104, the LED drive circuit 103 so operates that, in the on period (in the period when the PWM signal is on), a predetermined amount of current passes through the LED 200 and, in the off period (in the period when the PWM signal is off), no current passes through the LED 200.

More specifically, the PWM signal generation circuit 102 includes an A/D conversion circuit 121, a duty factor updating circuit 122, and a clock generation circuit 123.

The A/D conversion circuit 121 has an input line across which it continuously receives the lighting control voltage. The A/D conversion circuit 121 repeats sampling on the received lighting control voltage and thereby generates a digital signal (a signal that represents the value of the lighting control voltage as detected at each occasion of sampling).

The sampling is performed synchronously with a sampling clock signal received from the clock generation circuit 123. The A/D conversion circuit 121 has a grounded point (for example, a ground pattern), so that the potential difference between the input line and the grounded point is detected as the value of the lighting control voltage. That is, the value of the lighting control voltage is detected relative to the ground potential as a reference.

The duty factor updating circuit 122 has duty factor reference information set in it which represents the duty factor of the PWM signal, and updates the duty factor reference information according to the signal representing the value of the lighting control voltage received from the A/D conversion circuit 121. The duty factor reference information is updated repeatedly according to the successively received value of the lighting control voltage so as to reflect the newest value of the lighting control voltage.

More specifically, the duty factor updating circuit 122 has a duty factor updating period set in it (which is here assumed to correspond to five pulses of the sampling clock signal). Every duty factor updating period, the average value of the lighting control voltage sampled during that period is calculated, and the set duty factor reference information is updated with a value commensurate with (obtained by multiplying by a certain coefficient) the calculated value.

The duty factor updating circuit 122 generates a PWM signal according to the currently set duty factor reference information, and feeds it to the succeeding stage. More specifically, the PWM signal is generated such that the duty factor in each PWM period is equal to the duty factor as it is set at the start of that PWM period. In this way, in the generation of the PWM signal, every PWM period, the most recent duty factor reference information is reflected. The clock generation circuit 123 generates the sampling clock signal, and feeds it to the A/D conversion circuit 121.

FIG. 7 is a timing chart in illustration of the operation of the PWM signal generation circuit 102. Shown in FIG. 7 are the states (waveforms) of, from top down, the "sampling clock signal," the "lighting control voltage," the "updating of the duty factor reference information" (arrows indicating the timing of the updating), and the "PWM signal." Here, the lighting control voltage is assumed to have an ideal waveform (under no influence of noise).

As shown in FIG. 7, every duty factor updating period, the set duty factor reference information is updated according to the result of the detection of the lighting control voltage. In FIG. 7, D1 to D5 indicate the updated duty factor reference information. Every PWM period, the currently set duty factor reference information is referred to, and according to this duty factor reference information, the PWM signal is generated.

Operating in this way, the PWM signal generation circuit 102 generates the PWM signal according to the received lighting control voltage. For example, as shown in FIG. 7, when the lighting control voltage falls from Ea to Eb, in response, the PWM signal is so generated as to have a lower duty factor. With the LED control device 100, it is possible to perform PWM control of the electric power supplied to the LED 200 according to the received lighting control voltage.

LIST OF CITATIONS

Patent Literature

Patent Document 1: JP-A-2006-164842

SUMMARY OF INVENTION

Technical Problem

When a power control device supplies electric power to a load, the output current etc. generates electromagnetic noise. The noise affects the grounded point (for example, a ground pattern) within the power control device, for example, across a stray capacitance or a bypass capacitor, and causes variation in the ground potential (GND).

In the case of the LED control device 100 (a power control device that performs PWM control) described above, while electric power is supplied in the on period, almost no electric power is supplied in the off period. Thus, the noise varies in level in the on and off periods. Specifically, while noise resulting from the output of electric current etc. is large in the on period, such noise is extremely small in the off period. As a result, the ground potential in the LED control device 100 varies depending on whether or not the on period is currently occurring.

As described previously, in the sampling on the lighting control voltage in the LED control device 100, the value of the lighting control voltage is detected relative to the ground potential. Thus, relative to the value of the lighting control voltage detected in the off period, the value of the lighting control voltage detected in the on period contains an error due mainly to that variation in the ground potential (hereinafter, for convenience' sake, such an error is often referred to as a "detection error due to noise"). Even when the lighting control voltage being received has a constant value, as its value relative to the ground potential varies, a detection error due to noise as just mentioned does arise.

A detection error due to noise may make the duty factor of the PWM signal unstable (cause fluctuation or the like of the duty factor). For an easy grasp of this phenomenon, the operation of the PWM signal generation circuit 102 will be described below once again, this time with a detection error due to noise taken into consideration.

When a detection error due to noise is taken into consideration, the timing chart in FIG. 7 transforms into one largely as shown in FIG. 8. Even here, the waveform of the "lighting control voltage" is that relative to the ground potential (the waveform as it is detected by the A/D conversion circuit 121). Moreover, in FIG. 8, to make it easy how the duty factor becomes unstable, the lighting control voltage received is assumed to be constant. As shown in FIG. 8, even when the received lighting control voltage is constant, relative to the ground potential, the lighting control voltage in the off period (E1 in FIG. 8) and the lighting control voltage in the on period (E2 in FIG. 8) differ by the error mentioned above.

On the other hand, as described previously, the value (D1 to D5 in FIG. 8) of the duty factor reference information is determined, after the average value of the lighting control voltage detected in the duty factor updating period is calculated, according to this calculated value. Then, as shown in FIG. 8, in the duty factor updating periods corresponding to D1 and D4, the sampling on the lighting control voltage is performed three times in the off period and twice in the on period; by contrast, in the duty factor updating periods corresponding to D2 and D3, the sampling on the lighting control voltage is performed twice in the off period and three times in the on period.

Thus, when attention is paid to the average value of the detected lighting control voltage, whereas the average value corresponding to D1 and D4 is given by $$[3\times(E1)+2\times(E2)]/5,$$

the average value corresponding to D2 and D3 is given by $$[2\times(E1)+3\times(E2)]/5,$$

yielding different values.

Seeing that the received lighting control voltage is constant, D1 to D4 should have an equal value. Nevertheless, from the results mentioned above, D1 (or D4) and D2 (or D3) are determined to have different values.

Consequently, as shown in FIG. 8, unintended variation occurs in the duty factor (pulse width) of the PWM signal. That is, since the received lighting control voltage is constant, there should be no variation (fluctuation) in the duty factor; in reality, however, variation ascribable to a detection error due to noise does occur, making the duty factor of the PWM signal unstable.

When the duty factor of the PWM signal becomes unstable, it is difficult to control emission luminance properly. In particular, if the duty factor of the PWM signal becomes unstable when the lighting control voltage is constant, the light from the LED flickers, causing the user a greatly annoying sensation.

In general, the larger the current handled, the greater the difference in the amount of current between the on and off periods, and thus the more notable the detection error due to noise. Thus, in a case where the LED control device 100 is used, for example, as a control device for a backlight in a large liquid crystal display device (since a large number of LEDs are lit, a large current is handled), the fault may lead to serious results.

The above-described phenomenon of the duty factor of the PWM signal becoming unstable may occur in various situations other than the one specifically described above in cases where the sampling on the lighting control voltage is performed in the on period sometimes and in the off period other times (that is, sampling is performed mixedly in the on and off periods). Moreover, the phenomenon of the duty factor of the PWM signal becoming unstable may pose a problem not only in LED control devices but in a variety of devices (power control devices) that generate a PWM signal according to a voltage signal and perform PWM control of electric power supplied to a load.

In view of the inconveniences mentioned above, the present invention aims to provide a power control device which, despite being of the type that generates a PWM signal according to a voltage signal and performs PWM control of electric power supplied to a load, can avoid as much as possible a situation in which the duty factor of the PWM signal becomes unstable.

Solution to Problem

To achieve the above object according to one aspect of the invention, a power control device which generates a PWM signal according to an obtained voltage signal and performs PWM control of electric power supplied to a load includes: a sampling section which performs sampling on the voltage signal; and a duty factor updating section which updates the duty factor of the PWM signal according to the result of the sampling. Here, the sampling section inhibits the sampling from being performed in a masking period which is set to be one of the on and off periods of the PWM signal.

With this configuration, PWM control according to a voltage signal is possible, and in addition the sampling on the voltage signal is prevented from being performed in the on period sometimes and in the off period other times. Thus, it is possible to avoid as much as possible a situation where the duty factor of the PWM signal becomes unstable. Here, the "on period" denotes the period in which the PWM signal is in an on state, and the "off period" denotes the period in which the PWM signal is in an off state.

In the above configuration, there may be further provided a masking period updating section which updates the masking period by switching the masking period between the on and off periods.

With this configuration, it is possible to set the masking period to be whichever of the on and off periods is more appropriate according to the duty factor.

In the above configuration, the masking period updating section may be so configured that, when the duty factor is higher than a predetermined threshold value, the masking period updating section updates the masking period by setting the masking period to be the off period and, when the duty factor is lower than the predetermined threshold value, the masking period updating section updates the masking period by setting the masking period to be the on period.

With this configuration, it is possible to secure as long a period as possible in which sampling is permitted so that the duty factor is determined more properly.

In the above configuration, the sampling section may include: a clock generation circuit which generates a clock signal containing clock pulses at a constant period; a masking period checking circuit which checks whether or not the present time belongs to the masking period; a masking execution circuit which performs masking on the clock signal; and an AD conversion circuit which performs the sampling synchronously with the clock signal having undergone the masking. Here, the masking is a process whereby those of the clock pulses which occur in the masking period are invalidated.

With this configuration, it is possible to perform the sampling on the voltage signal synchronously with the clock signal while inhibiting the sampling in the masking period.

In the above configuration, more specifically, the power control device may be configured as an LED control device to which an LED or a plurality of LEDs are connected and which performs PWM control of the electric current passed through the LED or LEDs according to the voltage signal.

According to another aspect of the invention, a backlight unit includes: a backlight; and a power control device configured as described above. Here, the power control device performs PWM control of the electric power supplied to the backlight. With this configuration, it is possible to prevent the duty factor of the PWM signal from becoming unstable and thereby suppress flickering or the like of the backlight. It is thus possible to contribute to satisfactory image display.

In the above configuration, more specifically, the backlight may adopt an LED, and the power control device may perform PWM control of the electric current passed through the LED.

According to yet another aspect of the invention, a liquid crystal display device includes a backlight unit configured as described above. With this configuration, it is possible to make the most of the benefits of the backlight unit configured as described above.

Advantageous Effects of the Invention

As described above, with a power control device according to the present invention, it is possible to perform PWM control according to a voltage signal and in addition to prevent the sampling on the voltage signal from being performed in the on period sometimes and in the off period other times. It is thus possible to avoid as much as possible a situation where the duty factor of the PWM signal becomes unstable.

DESCRIPTION OF EMBODIMENTS

An embodiment of the present invention will be described below, taking as an example a liquid crystal display device in which PWM control is performed on the electric power supplied to a backlight.

[Configuration Etc. of Liquid Crystal Display Device]

Figure 1:
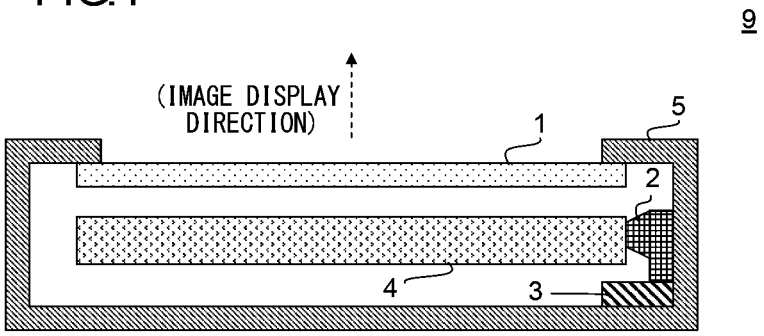
FIG. 1 is a configuration diagram of a liquid crystal display device embodying the invention.

FIG. 1 is an outline configuration diagram (in the form of a sectional view) of a liquid crystal display device embodying the invention. As shown there, the liquid crystal display device 9 has a liquid crystal panel 1, an LED 2, an LED control device 3, a light guide plate 4, etc. arranged inside a cabinet 5. The LED 2, the LED control device 3, and the light guide plate 4 together constitute a backlight unit for generating backlight.

The liquid crystal panel 1 is rectangular in shape as seen in a plan view, and has a pair of glass substrates bonded together with a predetermined gap in between, with liquid crystal sealed between the two glass substrates. The liquid crystal panel 1 is held in position by a bezel provided in the cabinet.

On one glass substrate, there are provided switching elements (for example, thin-film transistors) which are connected to source lines and gate lines which perpendicularly cross each other; pixel electrodes which are connected to those switching elements; an alignment film; etc. On the other glass substrate, there are provided color filters which have colored segments, such as R, G, and B (red, green, and blue) segments, arranged in a predetermined array; common electrodes; an alignment film; etc.

Outside the two substrates, polarizing plates are arranged. The liquid crystal panel 1 has, for example, 1920 by 1080 dots of color pixels for high-definition television. It may instead have any other number and type of pixels.

The LED 2 functions as a source of backlight, and its emission luminance varies with the electric current supplied to it. The electric power supplied to the LED 2 (the electric current passed through the LED 2) is controlled by the LED control device 3, and the emission luminance of the LED 2 is thereby controlled.

The LED 2 may be implemented in any way (in terms of number, type, color, combination, etc.). For example, the LED 2 may be a white LED, or an LED unit having LEDs combined together which emit light of different colors such as R, G, and B (red, green, and blue) or R, G, B, and W (red, green, blue, and white).

The LED control device 3 is composed of various circuits etc., and performs PWM control of the electric power supplied to the LED 2 (put another way, the luminance of the backlight). The configuration etc. of the LED control device 3 will be described in detail later.

The light guide plate 4 is formed of, for example, acrylic resin, and distributes over its entire surface the light received from the LED 2. The light guide plate 4 is arranged behind the liquid crystal panel 1. Thus, the light guide plate 4 shines evenly over its entire surface, and thereby illuminates evenly the entire display area of the liquid crystal panel 1 with backlight.

The liquid crystal display device 9 further includes a panel driver (not shown) for driving the liquid crystal panel 1. For example, according to image data obtained by reception of a broadcast, the panel driver switches the states of switching elements provided in the liquid crystal panel 1. As a result, how the backlight is transmitted at each pixel of the liquid crystal panel 1 is so adjusted as to display an image in the display area of the liquid crystal panel 1.

[Configuration Etc. of LED Control Device]

Figure 2:
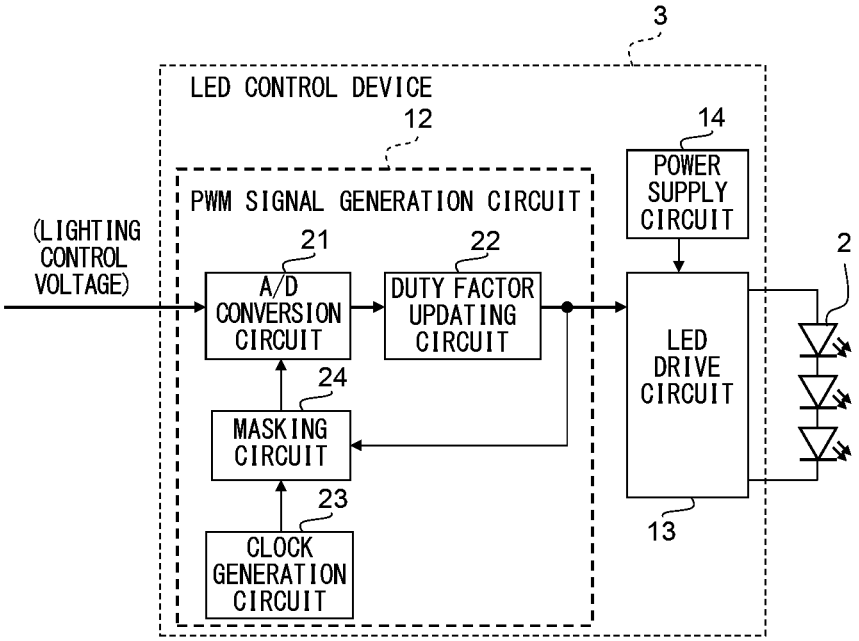
FIG. 2 is a configuration diagram of an LED control device embodying the invention.

Next, the configuration of the LED control device 3 will be described in more detail with reference to FIG. 2. As shown in FIG. 2, the LED control device 3 includes a PWM signal generation circuit 12, an LED drive circuit 13, a power supply circuit 14, etc.

The PWM signal generation circuit 12 receives a lighting control voltage from outside. The lighting control voltage is a voltage that represents the desired brightness of the backlight (the voltage value correlates with the degree of brightness), and is, for example, generated in another device provided in the liquid crystal display device 9 according to an instruction from the user. That is, the lighting control voltage is an analog voltage signal representing the desired brightness of the backlight.

According to the received lighting control voltage, the PWM signal generation circuit 12 generates a PWM signal (pulse signal) that is going to be used in the PWM control of the electric power supplied to the LED 2 (the electric current passed through the LED). As is well known, a PWM signal alternates between an H-level state (pulse state) and an L-level (non-pulse state). H level corresponds to an on state (where the LED 2 is lit by being fed with a predetermined current) and L level corresponds to an off state (the LED 2 is kept extinguished by being fed with no current). In the following description, the period in which the PWM signal is in the on state is referred to as the "on period," and the period in which the PWM signal is in the off state is referred to as the "off period."

More specifically, the PWM signal generation circuit 12 includes an A/D conversion circuit 21, a duty factor updating circuit 22, a clock generation circuit 23, and a masking circuit 24.

The A/D conversion circuit 21 has an input line across which it continuously receives the lighting control voltage from outside. The A/D conversion circuit 21 converts the received lighting control voltage into a digital signal, and feeds it to the duty factor updating circuit 22. That is, the A/D conversion circuit 21 repeats sampling on the received lighting control voltage (detects the voltage value at predetermined moments), and generates a digital signal (a signal that represents the value of the lighting control voltage as detected at each occasion of sampling).

The sampling is performed synchronously with a sampling clock signal received from the masking circuit 24. The A/D conversion circuit 21 has a grounded point (for example, a ground pattern), so that the potential difference between the input line and the grounded point is detected as the value of the lighting control voltage. That is, the value of the lighting control voltage is detected relative to the ground potential as a reference.

The duty factor updating circuit 22 has duty factor reference information set in it which represents the duty factor of the PWM signal, and updates the duty factor reference information according to the signal representing the value of the lighting control voltage received from the A/D conversion circuit 21. The greater the value of the lighting control voltage is, the greater value the duty factor reference information is set at. The duty factor reference information is updated repeatedly according to the successively received value of the lighting control voltage so as to reflect the newest value of the lighting control voltage.

More specifically, the duty factor updating circuit 22 has a duty factor updating period set in it (which is assumed to correspond to five pulses of an internal clock signal in this embodiment). Every duty factor updating period, the average value of the lighting control voltage sampled during that period is calculated, and the set duty factor reference information is updated with a value commensurate with (obtained by multiplying by a certain coefficient) the calculated value. The greater the calculated average value is, the greater value the duty factor reference information is set at.

The duty factor updating circuit 22 generates a PWM signal according to the currently set duty factor reference information, and feeds it to the succeeding stage. More specifically, the PWM signal is generated such that the duty factor in each PWM period is equal to the duty factor as it is set at the start of that PWM period.

In this way, in the generation of the PWM signal, every PWM period, the most recent duty factor reference information is reflected. As to how information on the value of the lighting control voltage is reflected in the duty factor of the PWM signal, many other implementations are possible.

The clock generation circuit 23 includes an oscillator etc., and generates an internal clock signal (for example, a signal containing clock pulses at a constant period of 80 μs) which is used mainly in the masking circuit 24. The generated internal clock signal is fed to the masking circuit 24.

The masking circuit 24 performs masking on the received internal clock signal (masking is a process whereby clock pulses are invalidated during a masking period). The "masking period" is interchangeably set to be one of the on and off periods of the PWM signal. "Invalidating" clock pulses denotes making them unrecognizable as such as by smoothing them.

The masking circuit 24 receives a feedback of the PWM signal. The masking circuit 24 monitors the fed-back PWM signal and so operates that, when its duty factor is higher than a previously set threshold value $\alpha$ (for example, 70%), the masking period is updated to be the off period and, when it is equal to or lower than the threshold value $\alpha$, the masking period is updated to be the on period.

The masking circuit 24 feeds the internal clock signal having undergone the masking (that is, having clock pulses invalidated in the masking period), as a sampling clock signal, to the A/D conversion circuit 21. As already mentioned, synchronously with this sampling clock signal, the A/D conversion circuit 21 performs the sampling on the lighting control voltage.

Figure 3:
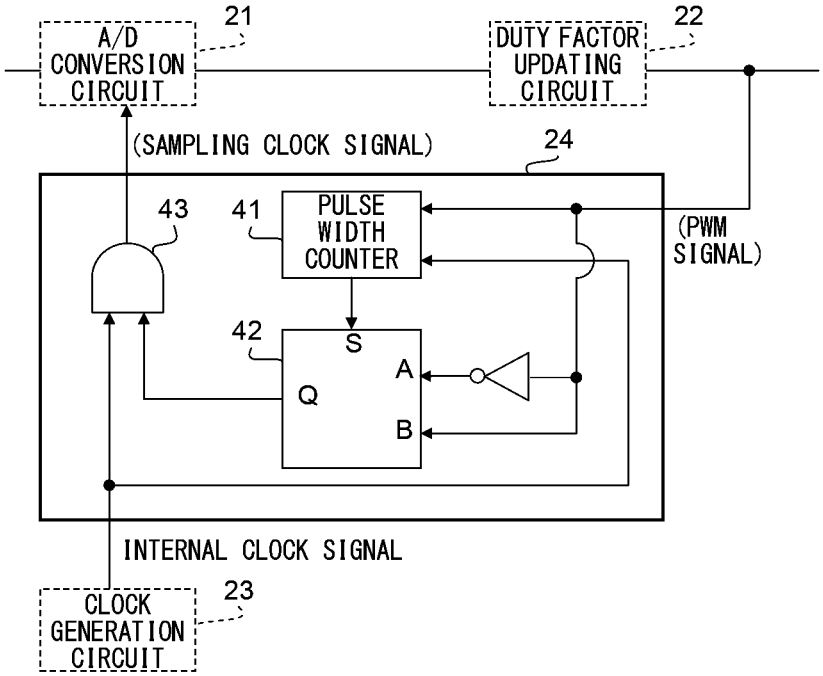
FIG. 3 is a configuration diagram of a masking circuit embodying the invention.

FIG. 3 shows a more specific configuration of the masking circuit 24. The masking circuit 24 shown there includes a pulse width counter 41, a selector 42, an AND circuit 43, etc.

The pulse width counter 41 receives the fed-back PWM signal and the internal clock signal. Every time the pulse width counter 41 receives a pulse in the PWM signal (every time the signal turns from L level to H level), it counts the width of the pulse (the period for which it remains at H level) by using the internal clock signal.

Since the PWM period is constant, determining the pulse width allows determining the duty factor of the PWM signal then. When the count result is greater than the value corresponding to the previously mentioned threshold value $\alpha$, the pulse width counter 41 outputs a logical value "1"; on the other hand, when it is equal to or smaller than the threshold value α, the pulse width counter 41 outputs a logical value "0".

For example, in a case where the PWM period is 5 ms, the pulse period of the internal clock signal is 80 μs, and the threshold value α is 70%, then the pulse width corresponding to the threshold value α is 44 clocks. Accordingly, when the count result is greater than 44 clocks, a logical value "1" is output, and when it is equal to or smaller than 44 clocks, a logical value "0" is output.

The selector 42 has the following terminals: an input terminal A, an input terminal B, a select terminal S, and an output terminal Q. To the input terminal A, the PWM signal having been logically inverted by an inverter is input. To the input terminal B, the PWM signal as it is (not having been logically inverted by an inverter) is input. To the select terminal S, the output signal of the pulse width counter 41 is input.

When the logical value of the signal input to the select terminal S is "0," the selector 42 lets the signal input to the input terminal A be output from the output terminal Q; when the logical value of the signal input to the select terminal S is "1," the selector 42 lets the signal input to the input terminal B be output from the output terminal Q.

The AND circuit 43 has two input terminals and one output terminal, and outputs from the output terminal the logical product (AND) of the two signals input to the input terminals. To one input terminal, the internal clock signal is input. To the other input terminal, the signal output from the selector 42 is input.

With the masking circuit 24 configured as shown in FIG. 3, when the duty factor of the PWM signal is higher than the threshold value α, the PWM signal is at H level, and if in addition the internal clock signal is at H level, the sampling clock signal is at H level (in the pulse state). By contrast, when the duty factor of the PWM signal is equal to or lower than the threshold value α, the PWM signal is at L level, and if in addition the internal clock signal is at H level, the sampling clock signal is at H level.

Thus, as the circuit configuration shown in FIG. 3 operates, the masking to be performed by the masking circuit 24 is executed. The masking circuit 24 may be implemented in any other way so long as it operates likewise.

Back in FIG. 2, the LED drive circuit 13 continuously receives the PWM signal from the PWM signal generation circuit 12, and drives the LED 2 according to the PWM signal. More specifically, by using the electric power supplied from the power supply circuit 14, the LED drive circuit 13, when the PWM signal is at H level (in the on period), passes a predetermined amount of current through the LED 2 and, when the PWM signal is at L level (in the off period), passes no current through the LED 2. Thus, the luminance of the LED 2 reflects the duty factor of the PWM signal.

As described above, the LED control device 3 generates a PWM signal according to an obtained lighting control voltage (which can be thought of as a voltage signal concerned with the adjustment of the luminance of the LED 2), and performs PWM control of the electric power supplied to the LED 2.

[Stability of the Duty Factor of the PWM Signal]

As discussed earlier with reference to FIG. 8, if the detected lighting control voltage contains a detection error due to noise, the duty factor of the PWM signal may become unstable. The LED control device 3, however, avoids that by performing masking. How this is achieved will now be described below with reference to timing charts in FIGS. 4 and 5.

Figure 4:
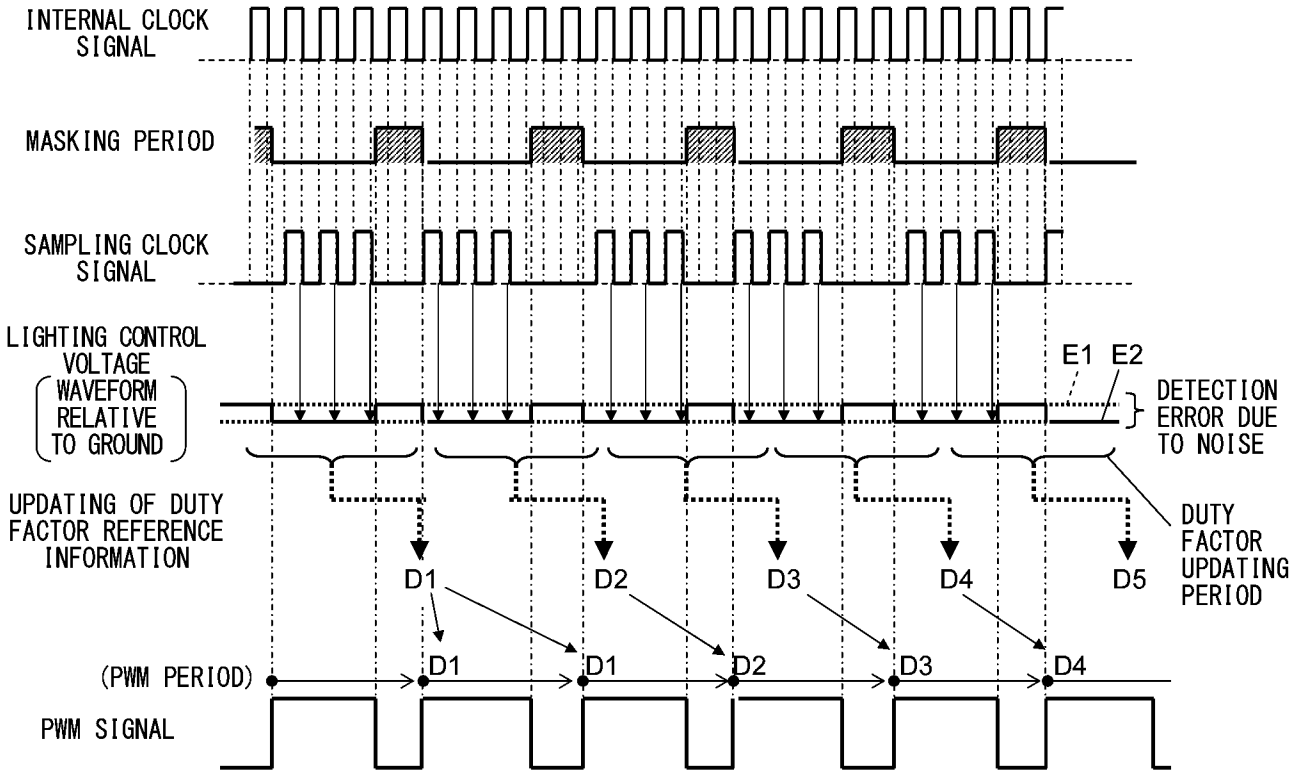
FIG. 4 is a timing chart in illustration of the operation of a PWM signal generation circuit embodying the invention.

FIG. 4 is a timing chart in illustration of the operation of the PWM signal generation circuit 12 in a situation where the duty factor of the PWM signal is higher than the threshold value α (in a case where a constant lighting control voltage is input). For easy comparison with FIG. 8, the items shown in FIG. 4 (and also in FIG. 5) are basically the same as those shown in FIG. 8 except that the "internal clock signal" and the "masking period" are additionally shown.

Specifically, shown in FIG. 4 (also in FIG. 5) are the states (waveforms) of, from top down, the "internal clock signal," the "masking period" (hatching indicating the masking period), the "sampling clock signal," the "lighting control voltage," the "updating of the duty factor reference information" (arrows indicating the timing of the updating), and the "PWM signal."

Here, it is to be noted that the waveform of the "lighting control voltage" is that relative to the ground potential (the waveform as it is detected by the A/D conversion circuit 21). As in FIG. 8, the lighting control voltage in the off period (E1 in FIG. 4) and the lighting control voltage in the on period (E2 in FIG. 4) differ only by a detection error due to noise.

As shown in FIG. 4, every duty factor updating period, duty factor reference information (D1 to D5 in FIG. 4) is determined and the set duty factor reference information is updated. Then, the PWM signal is generated such that the duty factor in each PWM period is equal to the duty factor reference information as it is set at the start of that PWM period.

Here, in a situation where the duty factor of the PWM signal is higher than the threshold value α, the masking period is set to be the off period, and thus masking is performed in the off period. Accordingly, as shown in FIG. 4, in the off period, no sampling on the lighting control voltage is performed. In other words, sampling is performed only in the on period. As a result the value of the lighting control voltage detected at each occasion of sampling constantly equals E2. Consequently, the average of the detected value remains constant (E2), and the duty factor (D1 to D5) is set at an equal value all the time.

Figure 5:
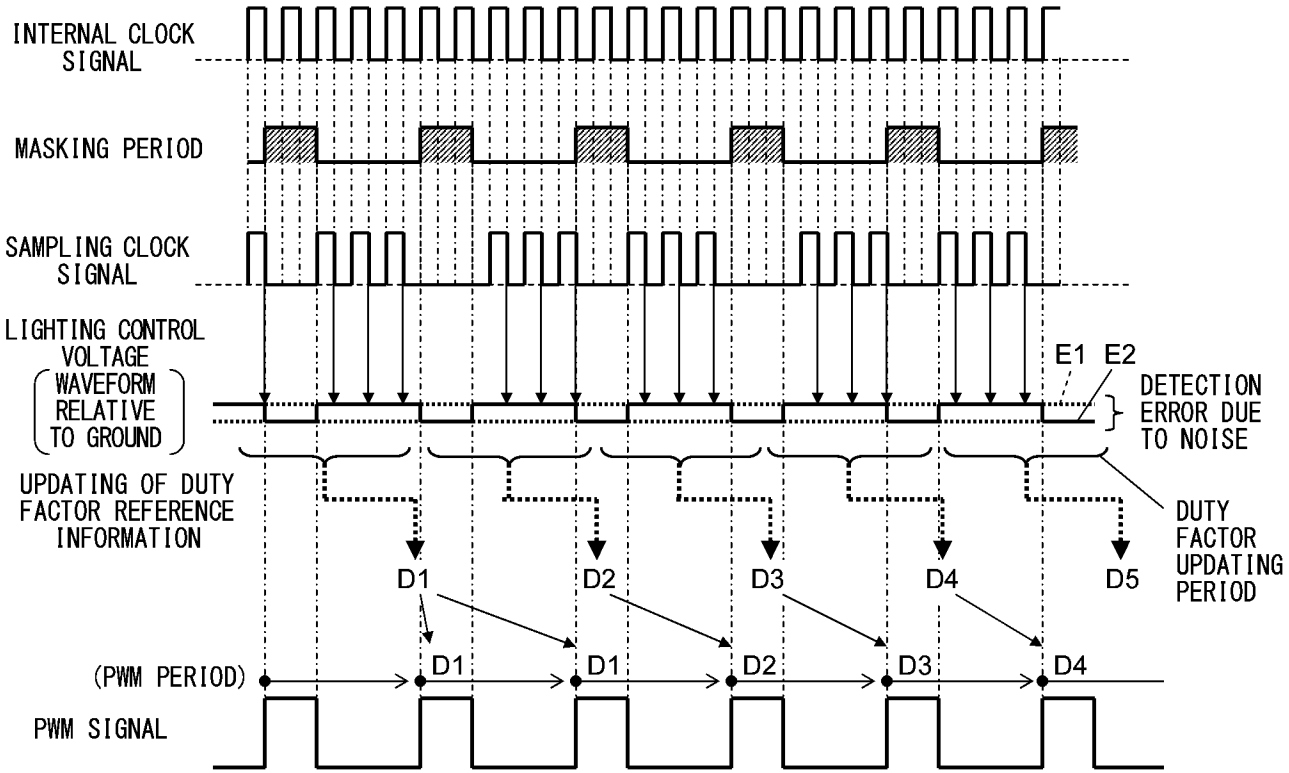
FIG. 5 is another timing chart in illustration of the operation of the PWM signal generation circuit.
Figure 6:
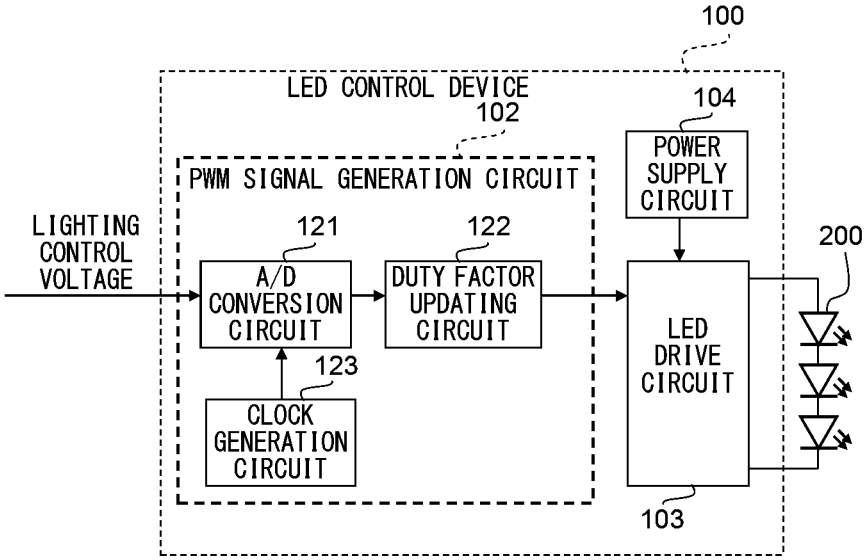
FIG.6 PRIOR ART
FIG. 6 is a configuration diagram of an example of a conventional LED control device.
Figure 7:
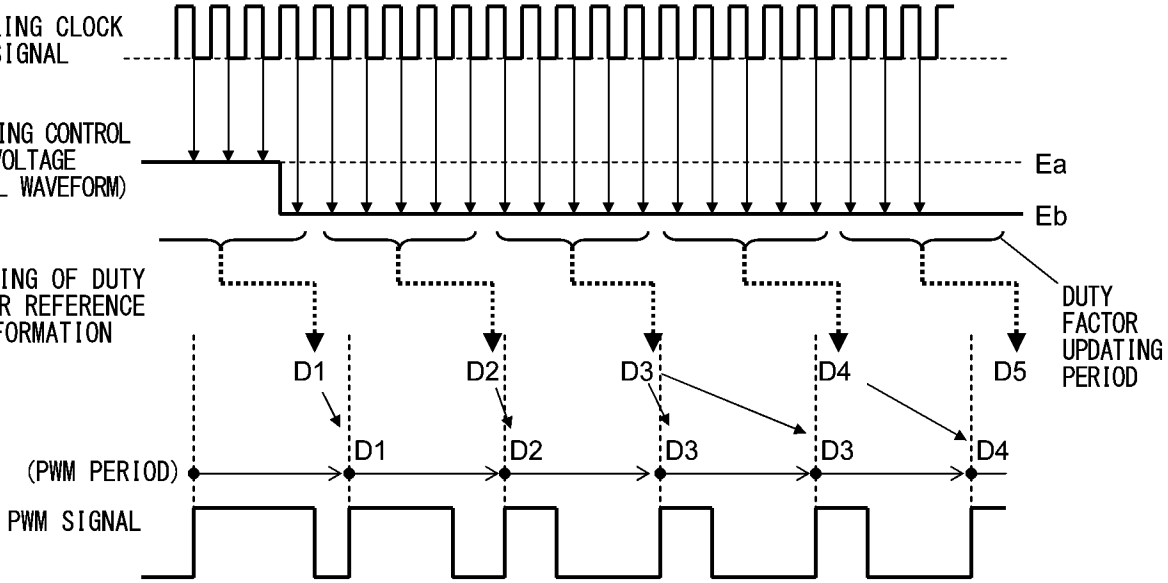
FIG.7 PRIOR ART
FIG. 7 is a timing chart in illustration of the operation of an example of a conventional PWM signal generation circuit (assuming that the waveform of the lighting control voltage is an ideal one)

FIG. 5 is a timing chart in illustration of the operation of the PWM signal generation circuit 12 in a situation where the duty factor of the PWM signal is lower than the threshold value α (in a case where a constant lighting control voltage is input). In a situation where the duty factor of the PWM signal is lower than the threshold value α, the masking period is set to be the on period, and thus masking is performed in the on period.

Accordingly, as shown in FIG. 5, in the on period, no sampling on the lighting control voltage is performed. In other words, sampling is performed only in the off period. As a result the value of the lighting control voltage detected at each occasion of sampling constantly equals E1. Consequently, the average of the detected value remains constant (E1), and the duty factor (D1 to D5) is set at an equal value all the time.

In this way, in the LED control device 3, except when the masking period is switched, it does not occur that the sampling on the lighting control voltage is performed in the on period sometimes and in the off period other times (that is, sampling is performed mixedly in the on and off periods). This helps avoid a situation where the duty factor of the PWM signal becomes unstable (see FIG. 8). In the examples shown in FIGS. 4 and 5, the received lighting control voltage is constant, and accordingly the duty factor of the PWM signal is constant (stable).

Figure 8:
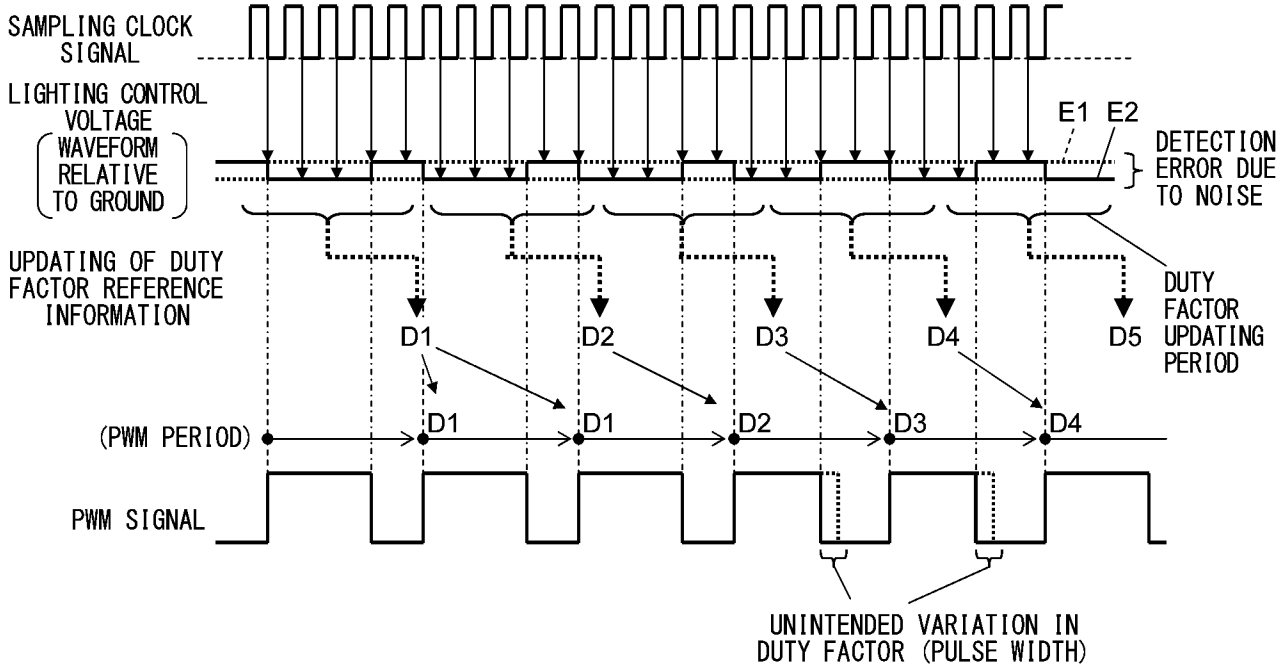
FIG.8 PRIOR ART
FIG. 8 is a timing chart in illustration of the operation of an example of a conventional PWM signal generation circuit (assuming that the waveform of the lighting control voltage is relative to the ground potential).

When the masking period is set to be the off period (sampling is performed only in the on period), the lighting control voltage detected does contain a detection error due to noise. Here, however, it is not that the lighting control voltage detected contains a detection error due to noise sometimes and does not other times (that is, in a state as shown in FIG. 8), but that it almost always contains one. This does not make the duty factor of the PWM signal unstable and usually does not cause hardly any problem.

[Switching of Masking Period]

As described previously, the masking circuit 24 so operates that, when the duty factor of the PWM signal is higher than the threshold value α, the masking period is updated to be the off period and, when it is equal to or lower than the threshold value α, the masking period is updated to be the on period. That is, when the duty factor is comparatively high (when the on period takes a comparatively large part), the masking period is set to be the off period, and the sampling on the lighting control voltage is inhibited in the off period; on the other hand, when the duty factor is comparatively low (when the off period takes a comparatively large part), the masking period is set to be the on period, and the sampling on the lighting control voltage is inhibited in the on period.

Thus, the main purpose of allowing the masking period to be switched is to secure at least a period long enough to permit sampling. For example, if the masking period is fixed to be the off period, in a situation where the duty factor of the PWM signal is very low, sampling is permitted only in the scarce period which occurs as the on period.

The shorter the period in which sampling is permitted, the smaller the number of times sampling can be performed. As a result, in the determination of the duty factor, for example, the lighting control voltage may be reflected improperly, or different kinds of noise may exert undue influence. Allowing the masking period to be switched as described above helps minimize such inconveniences.

The threshold value α is determined as follows. When priority is given to securing as long a period as possible in which sampling is permitted, it is preferable that the threshold value α be set at about 50%. When the masking period is switched, however, a detection error due to noise may, though only momentarily, affect the duty factor of the PWM signal and cause unintended variation in the emission luminance of the LED 2. Such variation in emission luminance is smaller and less noticeable the higher the emission luminance of the LED 2 originally is.

Accordingly, when priority is given to making variation in emission luminance less noticeable, it is preferable that the threshold value α be set at a comparatively great value (for example, about 70%). The threshold value α may be left variable whenever desired (for example, according to an instruction from the user).

The threshold value α may allow for hysteresis. Specifically, the threshold value α may be set in terms of two different values α1 and α2 (where α1>α2) so that, when the duty factor increases above α1, the masking period is set to be the off period and, when duty factor decreases below α2, the masking period is set to be the on period. With this configuration, even when the duty factor fluctuates around the threshold value, the masking period is prevented from becoming unstable.

The masking period may instead be kept from being updated; that is, the masking period may be fixed to be one of the on and off periods. Even with this configuration, it is possible to prevent the sampling on the lighting control voltage from being performed in the on period sometimes and in the off period other times, and thus to prevent a situation where the duty factor becomes unstable (see FIG. 8).

[Supplementary Notes]

As described above, in the LED control device 3 embodying the invention, a PWM signal is generated according to an obtained lighting control voltage (a kind of voltage signal), and PWM control is performed on the electric power supplied to an LED 2 (a kind of load). The LED control device 3 includes a functional section (sampling section) which performs sampling on the lighting control voltage and a functional section (duty factor updating section) which updates the duty factor of the PWM signal based on the result of the sampling.

The sampling section further has the function of performing masking, that is, the function of inhibiting sampling from being performed in a masking period which is set to be one of the on and off periods of the PWM signal.

Thus, with the LED control device 3, it is possible to perform PWM control according to the lighting control voltage and to prevent the sampling on the lighting control voltage from being performed in the on period sometimes and in the off period other times. It is thereby possible to prevent as reliably as possible a situation where the duty factor of the PWM signal becomes unstable.

The masking described above can be applied widely irrespective of the timing with which the voltage signal is sampled, how the sampled value is reflected in the PWM signal, etc. That is, while many specific implementations are possible as to how the PWM signal is generated based on the result of the sampling on the voltage signal, the masking described above can be applied to any of those implementations. In any case, it is possible to prevent the sampling on the voltage signal from being performed in the on period sometimes and in the off period other times, and thus to obtain benefits comparable with those obtained in this embodiment.

To inhibit the sampling on the voltage signal from being performed during the masking period, any method other than the masking described above may be adopted. For example, it is possible to detect the voltage signal synchronously with the sampling clock signal having a constant period, adopt as the result of the sampling the result of the detection only other than during the masking period, and thereby invalidate the result of detection during the masking period.

A backlight unit embodying the invention includes the LED control device 3 and a backlight which employs an LED 2 as a light source. Thus, the backlight unit prevents the duty factor of the PWM signal from becoming unstable, and thereby suppresses flickering or the like of the backlight, contributing to satisfactory image display.

A liquid crystal display device 9 embodying the invention includes the backlight unit described above. Thus, the liquid crystal display device 9, making the most of the benefits of the backlight unit, readily offers satisfactory image display.

The embodiment by way of which the present invention has been described above is not meant to limit the invention in any way. For example, power control devices according to the invention are not limited to LED control devices, but find wide applications in devices that perform PWM control of electric power supplied to some load. Embodiments of the invention allow for many modifications and variations within the spirit of the invention.

INDUSTRIAL APPLICABILITY

The present invention finds applications in backlight units for liquid crystal display devices and the like.

LIST OF REFERENCE SIGNS

1 liquid crystal panel
2 LED (load)
3 LED control device (power control device)
4 light guide plate
5 cabinet
9 liquid crystal display device
12 PWM signal generation circuit
13 LED drive circuit
14 power supply circuit
21 A/D conversion circuit
22 duty factor updating circuit
23 clock generation circuit
24 masking circuit

The invention claimed is:

1. A power control device which generates a PWM signal according to an obtained voltage signal and performs PWM control of electric power supplied to a load, the power control device comprising:

a sampling section which performs sampling on the voltage signal;

a duty factor updating section which updates a duty factor of the PWM signal according to a result of the sampling; and a masking period updating section which updates a masking period by switching the masking period between on and off periods of the PWM signal; wherein the sampling section inhibits the sampling from being performed in the masking period which has been switched and set to be one of the on and off periods of the PWM signal;

when the duty factor is higher than a predetermined threshold value, the masking period updating section updates the masking period by setting the masking period to be the off period; and when the duty factor is lower than the predetermined threshold value, the masking period updating section updates the masking period by setting the masking period to be the on period.

2. The power control device according to claim 1, wherein the sampling section comprises:

a clock generation circuit which generates a clock signal containing clock pulses at a constant period;

a masking period checking circuit which checks whether or not present time belongs to the masking period;

a masking execution circuit which performs masking on the clock signal; and an AD conversion circuit which performs the sampling synchronously with the clock signal having undergone the masking, wherein the masking is a process whereby those of the clock pulses which occur in the masking period are invalidated.

3. The power control device according to claim 2, wherein the power control device is an LED control device to which an LED or a plurality of LEDs are connected and which performs PWM control of an electric current passed through the LED or LEDs according to the voltage signal.

4. A backlight unit, comprising:

a backlight; and the power control device according to claim 2, wherein the power control device performs PWM control of electric power supplied to the backlight.

5. A backlight unit, comprising:

a backlight; and the power control device according to claim 1, wherein the power control device performs PWM control of electric power supplied to the backlight.

6. The backlight unit according to claim 5, wherein the backlight adopts an LED, and the power control device performs PWM control of electric current passed through the LED.

7. A liquid crystal display device, comprising the backlight unit according to claim 5.

8. The power control device according to claim 1, wherein the power control device is an LED control device to which an LED or a plurality of LEDs are connected and which performs PWM control of an electric current passed through the LED or LEDs according to the voltage signal.

9. A backlight unit, comprising:

a backlight; and the power control device according to claim 1, wherein the power control device performs PWM control of electric power supplied to the backlight.

* * * * *